US007248183B2

(12) United States Patent
Pfleging et al.

(10) Patent No.: US 7,248,183 B2
(45) Date of Patent: Jul. 24, 2007

(54) METHOD AND APPARATUS FOR SECURE TRAFFIC LIGHT INTERRUPTION

(75) Inventors: Gerald W. Pfleging, Batavia, IL (US); George Paul Wilkin, Bolingbrook, IL (US)

(73) Assignee: Lucent Technologies Inc., Murray Hill, NJ (US)

( * ) Notice: Subject to any disclaimer, the term of this patent is extended or adjusted under 35 U.S.C. 154(b) by 201 days.

(21) Appl. No.: 11/170,913

(22) Filed: Jun. 30, 2005

(65) Prior Publication Data

US 2007/0001871 A1 Jan. 4, 2007

(51) Int. Cl.
*G08G 1/095* (2006.01)

(52) U.S. Cl. ..... 340/907; 340/906; 340/908; 340/686.1; 340/691.3; 340/988

(58) Field of Classification Search ..... 340/907, 340/906, 908, 686.1, 691.3, 988
See application file for complete search history.

(56) References Cited

U.S. PATENT DOCUMENTS 4,016,532 A * 4/1977 Rose ..... 340/906
4,775,865 A * 10/1988 Smith et al. ..... 340/906
5,187,476 A * 2/1993 Hamer ..... 340/906
6,744,352 B2 6/2004 Lesesky et al.

* cited by examiner

*Primary Examiner*—Tai Nguyen

(57) ABSTRACT

This invention relates to a method and apparatus for secure traffic light interruption. A purpose of this invention is to allow for the use of a secure system to allow the interruption of the traffic light signals by emergency (and other authorized) vehicles. An objective of this invention is to allow for the use of a more secure system than the currently installed strobe only traffic light interruption (changing) systems. This invention integrates additional wireless technologies to assure that only authorized users trigger the traffic light changes that typically make it safer for emergency vehicles when they approach a traffic light.

29 Claims, 5 Drawing Sheets

METHOD AND APPARATUS FOR SECURE TRAFFIC LIGHT INTERRUPTION

BACKGROUND OF THE INVENTION

This invention relates to a method and apparatus for secure traffic light (emergency vehicle changing) interruption. More particularly, the techniques according to the presently described embodiments provide a secure system to allow the interruption of traffic light signals by emergency (and other authorized) vehicles. This is an improvement over the conventional strobe only traffic light interruption (changing) systems. In one form, the presently described embodiments integrate wireless technologies to assure that only authorized users can trigger the traffic light changes that make it safer for emergency vehicles when they approach a traffic light.

While the invention is particularly directed to the art of traffic light interruption, and will be thus described with specific reference thereto, it will be appreciated that the invention may have usefulness in other fields and applications. For example, the invention may be used in other applications where emergency interruption of a system is desired.

By way of background, emergency interruption systems operative to control traffic signals, by permitting interruption by emergency (and other authorized) vehicles, are known. Typically, a system of installed traffic light sensors operate by detecting a rapidly strobing light source approaching from a line of sight distance of up to almost 1,800 feet. The detection devices are normally mounted on the cross bar of the traffic light poles. Once the sensor detects an approaching device, the sensor locks onto the device to determine if preemption should occur.

Some systems simply look for a strobe in any pattern. More advanced systems look for specific strobe patterns before initiating the sequence to change the light.

Referring to FIG. 1, an example of an emergency vehicle 12 entering an area of a traffic light system 10 with an emergency interruption system follows. The system 10 includes a traffic light 14 and a strobe unit or flood lamp system 16, both supported by a structure 18. The vehicle 12 includes a signaling unit 20.

In operation, if the vehicle 12 already has a green light, the light 14 will remain green. Any other direction that also has a green light (usually the opposite direction) will first get a yellow light, then a red light.

When all of the lights of the traffic light 14 facing other directions are turned red, and the vehicle's direction is the only light that is green, the left turn arrow will illuminate (if one exists). A brilliant white flood lamp 16 mounted near the traffic signal 14 will then begin to flash. This flood lamp 16 tells the driver of the fire truck that he now has control of the intersection and, thus, a complete right-of-way.

If the vehicle 12 sees a red light, any other direction that has a green light will transition to a yellow light, then a red light. When the lights facing all the directions (including the fire truck's) are red lights, the traffic signal facing the fire truck will then turn to a green light, along with the left turn arrow (if one exists), and the brilliant white flood lamp 16 will begin to flash.

Once the vehicle 12 has passed through the intersection, optical communication with the preemption detector (on the traffic signal) is lost. At that time, the traffic signal will default back to normal operation. Conversely, until the fire truck passes through the intersection, it will have a green light, regardless of the time duration.

Of course, this is merely one example of a conventional system. Other variations exist.

No matter the form, however, current technology is often circumvented by persons who use a strobe to trick lights into the pass through mode, which is usually reserved for law enforcement or fire personnel. This is a danger to the community and represents a hazard.

More specifically, it has become not too uncommon for non-authorized individuals to purchase emitting devices from online and other retailers. The users install the devices in their cars or other vehicles to change the lights when they do not want to be delayed by the regular sequence of the traffic light. Although this is illegal, it is difficult to identify the person or vehicle. Of course, it could have severe consequences. There have been several accidents across the country already.

The present invention contemplates a new and improved traffic light interruption system that resolves the above-referenced difficulties and others.

SUMMARY OF THE INVENTION

A method and apparatus for an improved interruption cycle for traffic signals are provided.

In one aspect of the invention, a method for providing an interruption cycle for a traffic light system, the method comprises recognizing a first signal from a signaling unit of a vehicle, locking on to the first signal, transmitting a second signal to the signaling unit of the vehicle, receiving a third signal in response to the second signal, determining if the third signal includes information validating the signaling unit of the vehicle as being authorized and, initiating the interruption cycle if the signaling unit is authorized.

In another aspect of the invention, the first signal is a strobe pattern.

In another aspect of the invention, the transmitting comprises transmitting at least one message requesting identification as the second signal.

In another aspect of the invention, the transmitting comprises transmitting a wake up signal as the second signal.

In another aspect of the invention, the third signal includes identification information.

In another aspect of the invention, the determining comprises accessing a database.

In another aspect of the invention, the method comprises waiting for a next detection if the signaling unit is not authorized.

In another aspect of the invention, the method comprises activating a camera to record unauthorized use if the signaling unit is not authorized.

In another aspect of the invention, the method comprises activating the camera to record traffic violations during the interruption cycle.

In another aspect of the invention, the method further comprises communicating with a central dispatch unit if the signaling unit is authorized.

In another aspect of the invention, a system for providing an interruption cycle for a traffic light system comprises means for recognizing a first signal from a signaling unit of vehicle, means for locking on to the first signal, means for transmitting a second signal to the signaling unit of the vehicle, means for receiving a third signal in response to the second signal, means for determining if the third signal includes information validating the signaling unit of the vehicle as being authorized and, means for initiating the interruption cycle if the signaling unit is authorized.

In another aspect of the invention, the first signal is a strobe pattern.

In another aspect of the invention, the second signal comprises at least one message requesting identification.

In another aspect of the invention, the second signal comprises a wake up signal.

In another aspect of the invention, the third signal includes identification information.

In another aspect of the invention, the means for determining comprises means for accessing a database.

In another aspect of the invention, the system further comprises a means for waiting for a next strobe detection if the signaling unit is not authorized.

In another aspect of the invention, the system further comprises means for activating a camera to record unauthorized use if the signaling unit is not authorized.

In another aspect of the invention, the system further comprises means for activating the camera to record traffic violations during the interruption cycle.

In another aspect of the invention, a system for receiving signals from a signaling unit of a vehicle comprises a signal detector operative to detect first signals from the signaling unit and a processing module operative to receive the first signals, lock on to the first signals, transmit a second signal to the signaling unit of the vehicle, receive a third signal in response to the second signal, determine if the third signal includes information validating the signaling unit of the vehicle as being authorized, and initiate an interruption cycle if the signaling unit is authorized.

In another aspect of the invention, the first signal is a strobe pattern.

In another aspect of the invention, the second signal comprises at least one message requesting identification.

In another aspect of the invention, the second signal comprises a wake up signal.

In another aspect of the invention, the third signal includes identification information.

In another aspect of the invention, the processing module is operative to determine based on accessing a database.

In another aspect of the invention, the processing module is operative to wait for a next signal detection if the signaling unit is not authorized.

In another aspect of the invention, the processing module is operative to activate a camera to record unauthorized use if the signaling unit is not authorized.

In another aspect of the invention, the processing module is operative to activate the camera to record traffic violations during the interruption cycle.

In another aspect of the invention, the processing module is operative to communicate with a central dispatch unit if the signaling unit is authorized.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

According to the presently described embodiments, traffic signal interruption systems are made more secure. To date, the approach has been to simply change the way the strobe patterns work to keep unauthorized systems (e.g., home built or store bought systems) from changing the lights. However, the makers of the unauthorized devices continue to adapt to beat the system.

The addition of a secure wireless device is implemented by the presently described embodiments to overcome difficulties with the conventional technology. Secure devices have already been introduced to cars to pay tolls electronically, as drivers speed through sensor locations. The addition of the present invention into emergency vehicles could combine with such current strobe sensor technology to form a more secure traffic signal interruption system.

In addition, metro WANs formed by high speed wireless and/or mesh networks are being installed in many cities as well. These can also be used to strengthen the security of these light changing systems.

Figure 1:
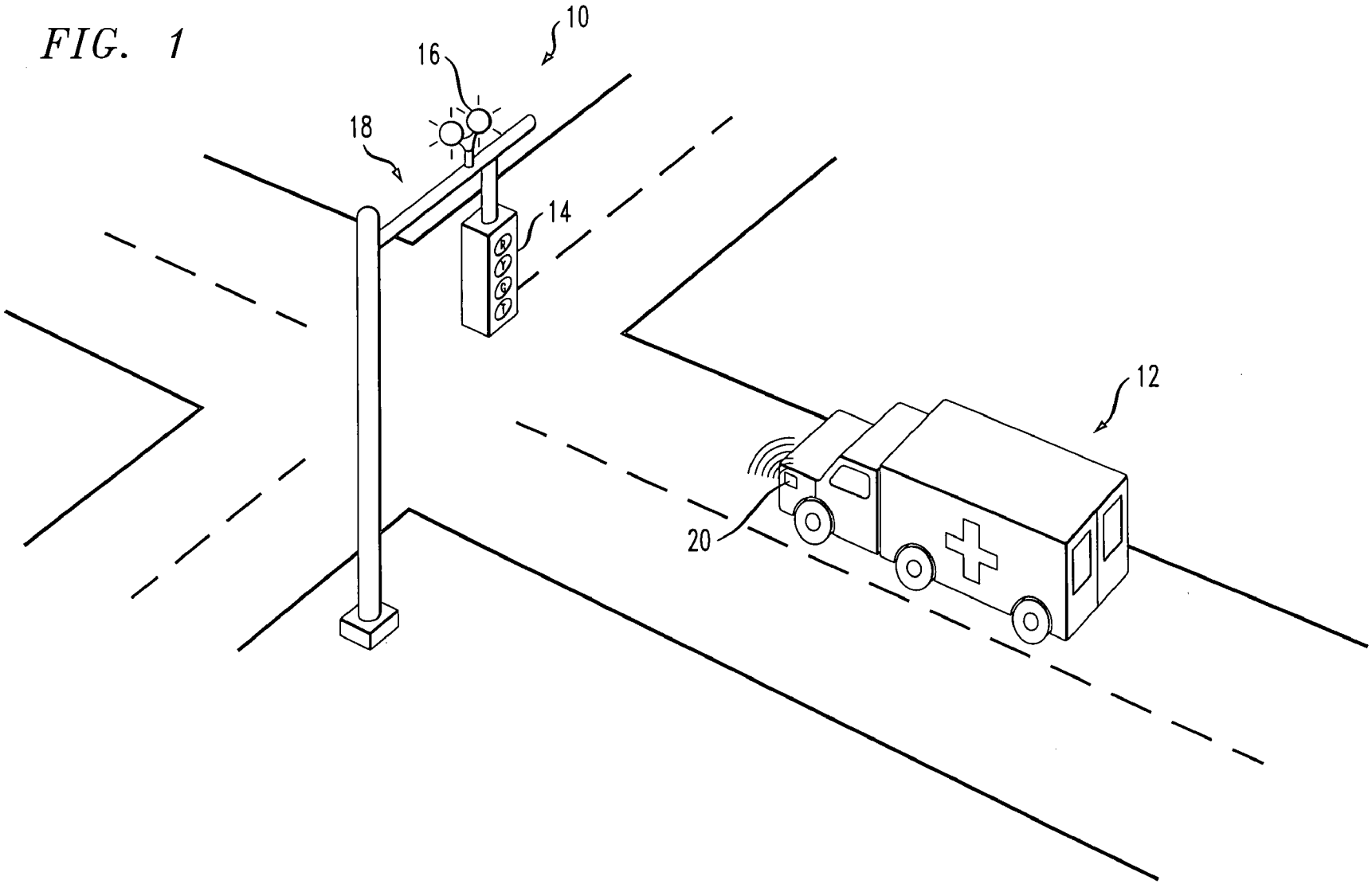
FIG. 1 shows a prior art traffic interruption system.
Figure 2:
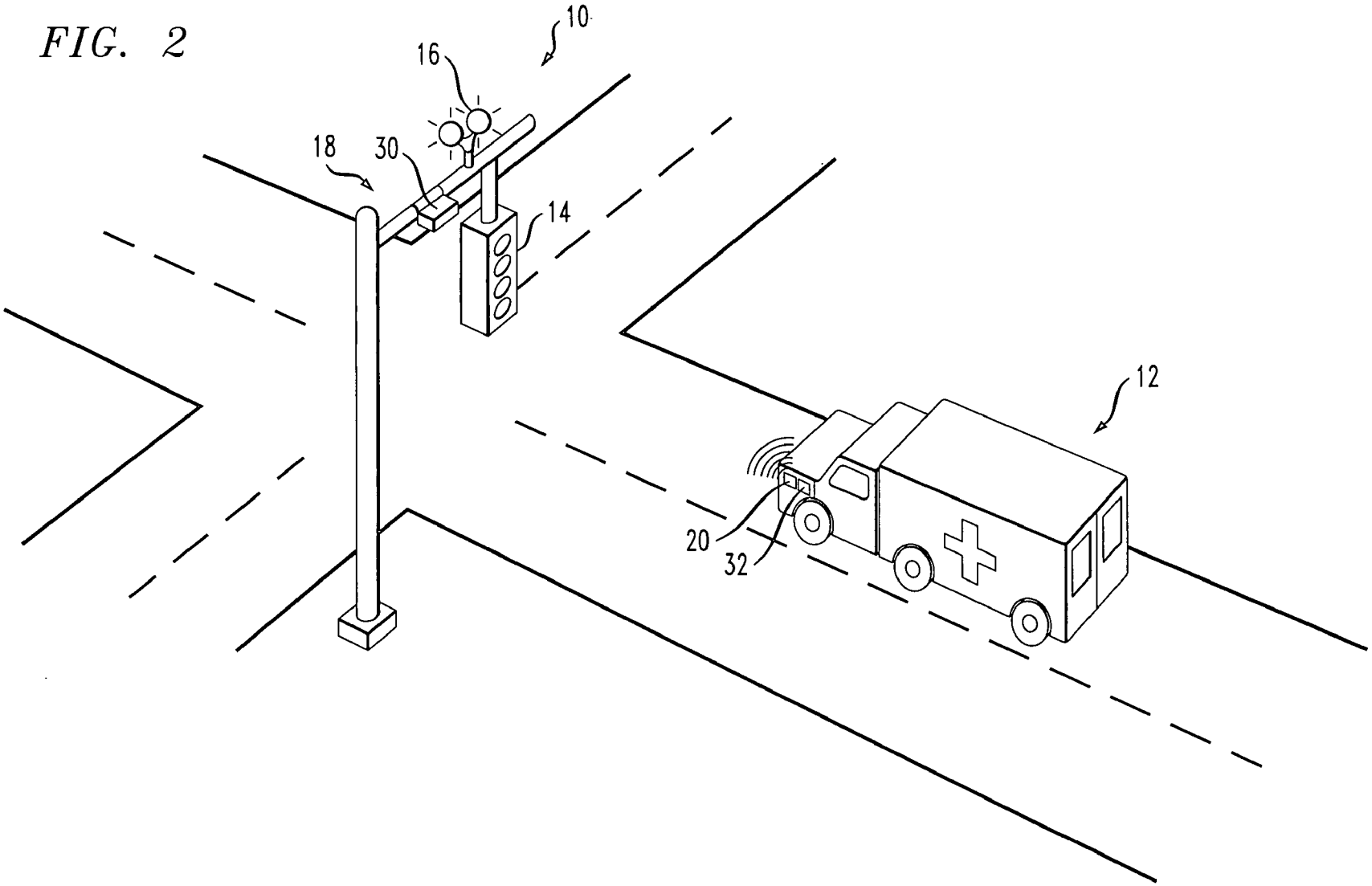
FIG. 2 shows a traffic light interruption system according to the presently described embodiments.

Referring now to the drawings wherein the showings are for purposes of illustrating the preferred embodiments of the invention only and not for purposes of limiting same, FIG. 2 provides a view of one exemplary system incorporating the teachings of the presently described embodiments. As shown, a traffic light system 10 is approached, in one form, by an emergency (or other authorized) vehicle 12. The traffic light system 10 includes a stop light 14 as well as a strobe or flood lamp unit 16 that serves as a traffic light interruption system.

According to the presently described embodiments, a processing module 30 is also incorporated in the traffic light system 10 to enhance the interruption process. All of these elements are supported by a structure 18. In addition, the emergency vehicle 12 includes a signaling unit 20 which is also provided with an identification module 32.

The elements 14, 16, 18, and 20 operate substantially as in conventional systems. For example, the unit 20 may provide strobe patterns that are recognized by the system. It will be understood that other configurations and/or elements may also exist. However, their functionality may be impacted by the implementation of a processing module 30 in the traffic light system 10, as well as the implementation of the identification module 32 in the signaling unit 20 of the vehicle 12.

It should be appreciated that the identification module 32 operates in a manner to provide a signal including information on the identification of the unit, and/or the vehicle 12.

The module 32 may take a variety of forms that are well known in the art. For example, it may take the form of a radio frequency identification (RFID) signaling unit that is commonly used and available for toll booth applications. However, it may also simply take the form of any signaling unit that can provide suitable information in accord with the presently described embodiments. Strobe patterns or other signals may be generated thereby. The various forms of this module should be apparent to those of skill in the art.

Figure 3:
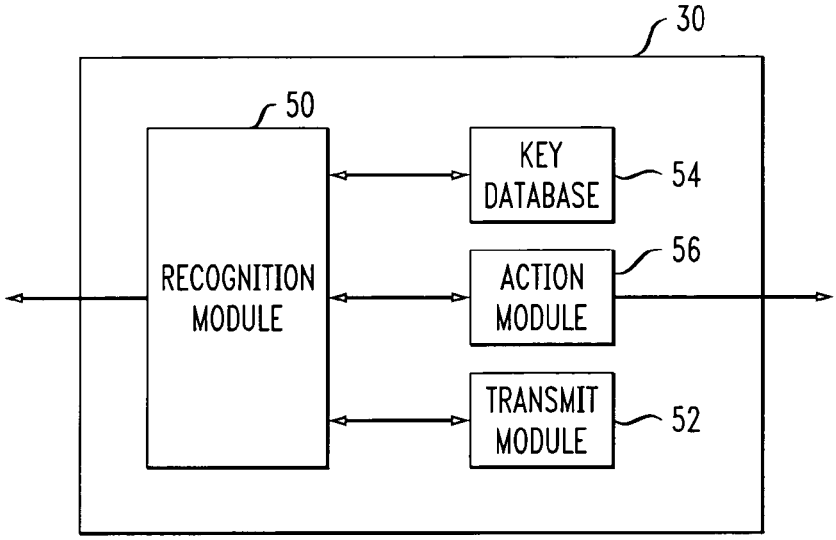
FIG. 3 shows a processing module according to the presently described embodiments.

With reference now to FIG. 3, the processing module 30 is illustrated. This module includes a recognition module 50 and a transmit module 52. Also shown are a key database 54 and an action module 56.

Recognition module 50 is operative to recognize signaling patterns from oncoming vehicles once detected by the strobe unit 16. As noted above, these signals may take a variety of forms, including that of a strobe pattern. The transmit module 52 is operative to transmit signals to the oncoming vehicle to obtain identification of the oncoming vehicle. Of course, the transmit module 52 may simply provide a wake up signal to the identification module 32 or it may send one or a series of protocol messages to request identification from the identification module 32. In either case, the objective is to obtain identification information from the oncoming vehicle. This information may be in a variety of forms, including a strobe pattern having an identification key. Once this information is obtained, the recognition module 50 accesses the key database 54 to determine if the identification key provided by the vehicle matches the list of authorized identification keys.

Once this determination is made, the action module 56 then takes a variety of actions according to the results. For example, if the user is not an authorized user, the action module 56 may simply wait for another signaling pattern to be detected. However, if the identification key is determined to be an authorized key, then the action module may simply initiate the interruption cycle, as those of skill in the art will appreciate. In either case, as will be described below, the action module 56 may also perform a variety of other functions. For example, the action module 56 may activate cameras for purposes of recording unauthorized use of the traffic interruption system or it may also activate the cameras to record red light violations during the interruption cycle.

It should be appreciated that the processing module 30 may be implemented in a variety of manners that will be apparent to those of skill in the art upon reading of this disclosure. However, in at least one form, the processing module 30 takes the form of suitable software routines and complementary hardware techniques to implement the modules as shown. It also, in one form, is a wireless device that is able to communicate using suitable wireless protocols such as 802.11, RFID, and others. It may also be incorporated within the housing of the traffic light or integral with the unit 16. The module 30 may also be provided with or have access to an antenna, where necessary. Moreover, in one form, the logic of the module 30 is distributed to many light systems. However, this logic may also be centralized (e.g., in a system such as that shown in FIG. 7).

Figure 4:
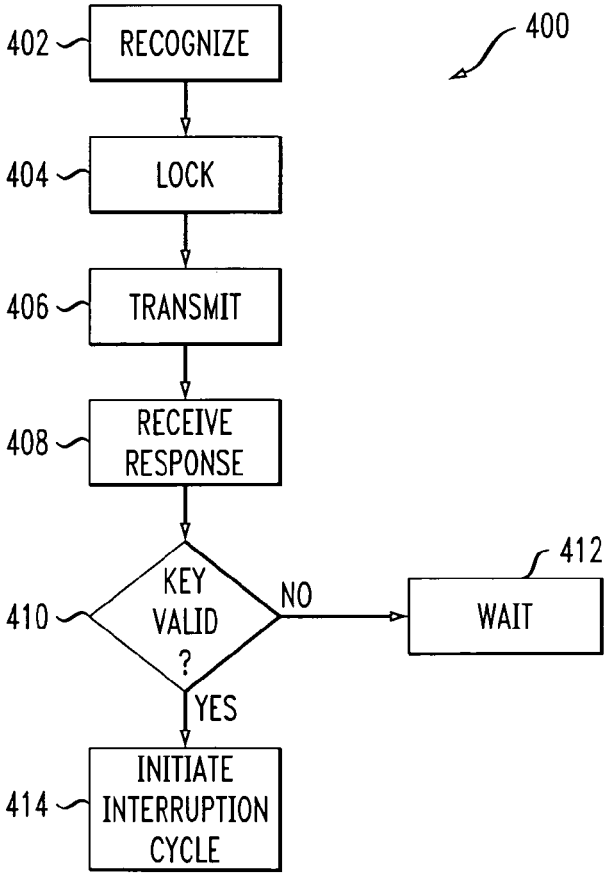
FIG. 4 shows a flow chart illustrating a method according to the presently described embodiments.

In operation, the system described in connection with FIGS. 2 and 3 may be implemented as a method 400, as shown in FIG. 4. As illustrated, the method 400 is initiated upon recognition by the processing module that a particular signaling pattern is received (at 402). The received signal, in one form, is a strobe pattern. The module then locks on to the signal (at 404). This is accomplished using any of a variety of known techniques. The processing module then transmits a signal to the oncoming vehicle (at 406). As noted above, the transmission may simply include a wake up signal or it may include a series of protocol messages. In either case, the objective is for the processing module 30 to receive an identification key from the oncoming vehicle to verify whether the use is authorized.

The response from the signaling unit of the vehicle is then received by the processing module (at 408). At this point, if an identification key is received, a determination is made as to whether the received key is valid (at 410). If not, in one form, the system simply is put in a wait state (at 412) to await another signaling pattern (e.g., another strobe pattern of an oncoming vehicle). If, however, the key is valid, an interruption cycle may be initiated (at 414).

In operation, the system of FIGS. 2–4 is operative according to methods described herein. In one practical example, a fire truck strobe emits its normal signal as it nears a traffic signal. The traffic signal sees the strobe and locks onto it. The traffic signal's wireless transmitter (e.g., module 30) emits a wireless pulse to activate the secure device in the fire truck's cab, similar to the function of an electronic toll booth. The secure device in the cab of the truck then emits a pulse of data back to the traffic signal that contains its ID number.

The receiver (e.g., module 30) at the traffic signal receives the ID and checks locally, e.g., in key database 54, that the ID is valid to determine if the signals should be changed. In a more advanced system, such as in a large city, the system may relay the ID over a high speed network to determine if the light sequence should be altered.

If the ID does match a valid one, then the light changing sequence could progress as it conventionally does.

In at least one form, the wireless secure device (e.g., module 30) uses a wireless technology that is sufficiently fast and powerful enough to emit the proper signals. Current standards such as 802.11 and 806.16 are able to be correctly tuned for this purpose. RFID may also be suitable if distance is not an issue.

Figure 5:
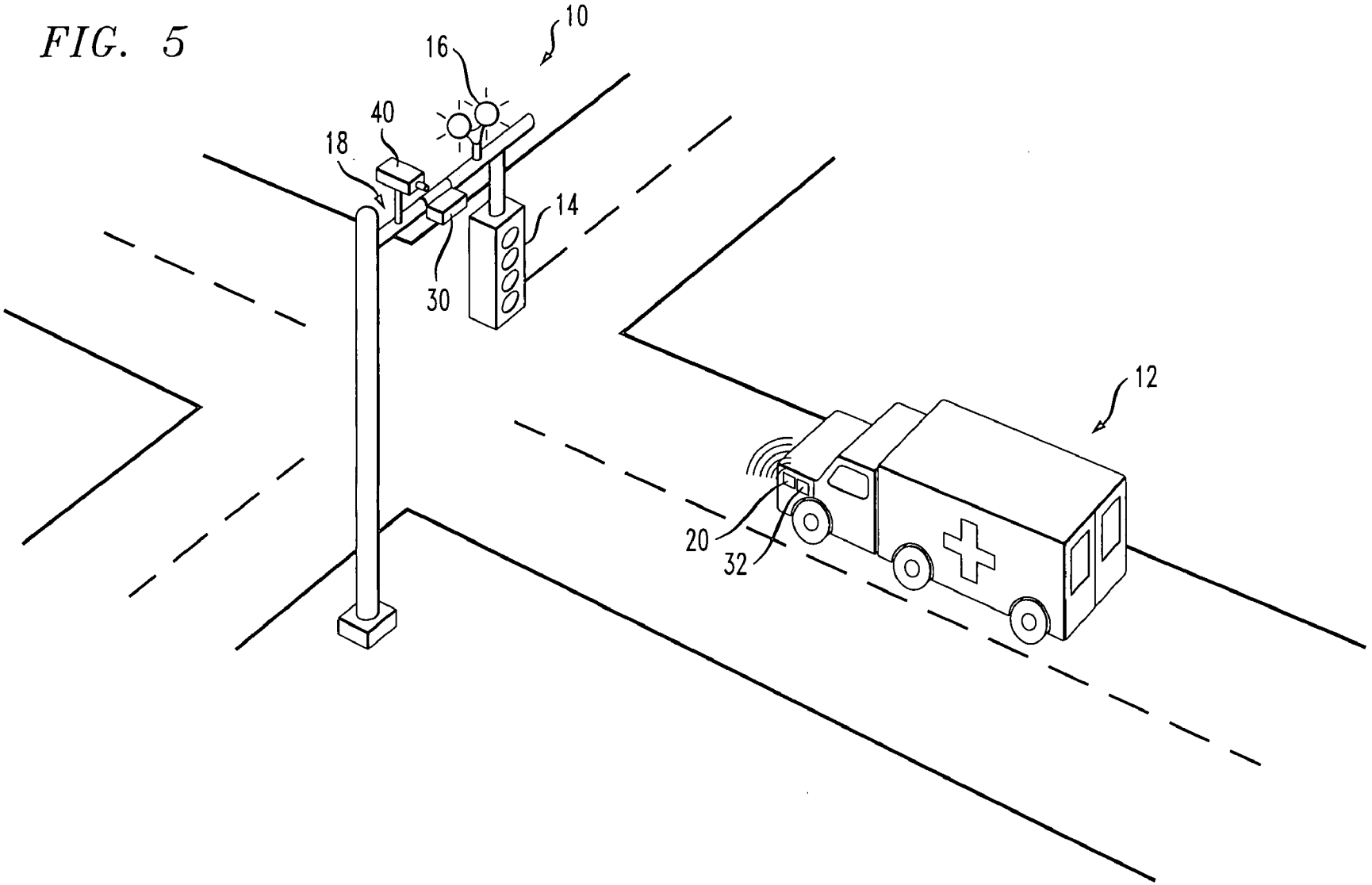
FIG. 5 shows another form of the presently described embodiments.

With reference now to FIG. 5, an alternative system according to the presently described embodiments is shown. In this system, the illustrated elements correspond to the elements illustrated in FIG. 2. FIG. 5, however, shows an additional element—a camera 40. It should be understood that this camera may take a variety of forms that are well known in the art. However, the camera, in one form, is operative to receive signals from the action module 56 of the processing module 30 to become operative as contemplated herein.

Figure 6:
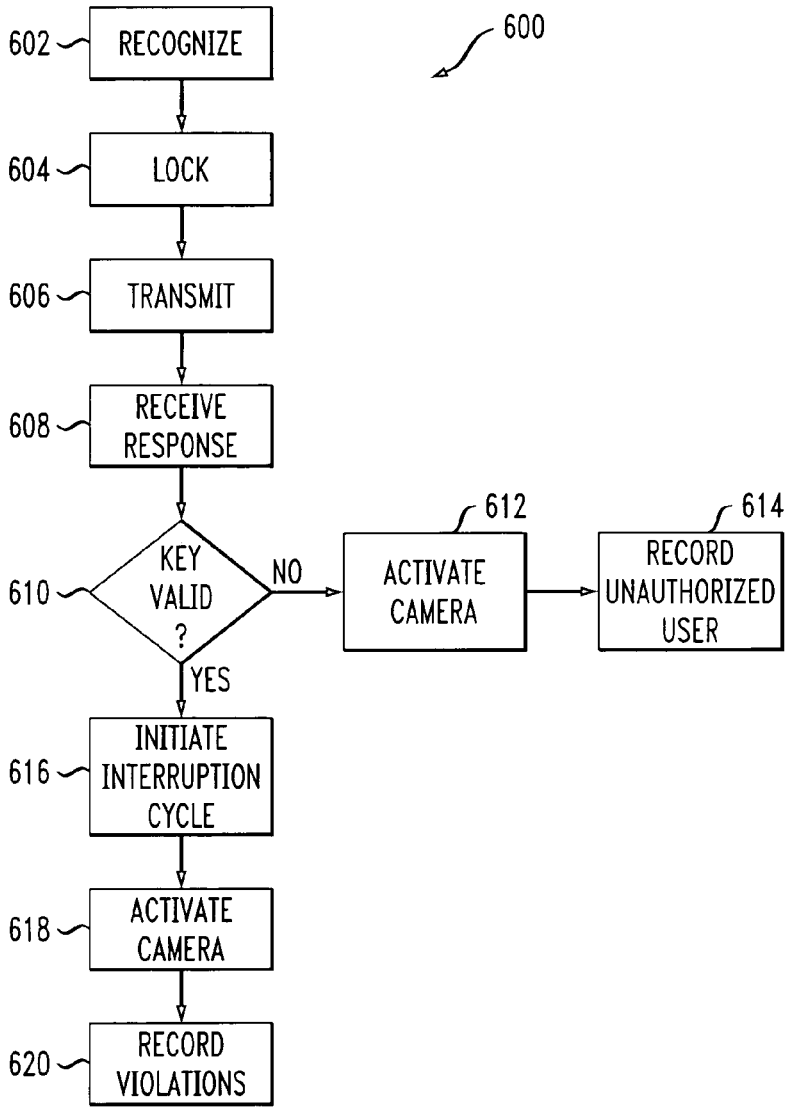
FIG. 6 illustrates another method according to the presently described embodiments; and, FIG. 7 illustrates a centralized system according to the presently described embodiments.

With reference now to FIG. 6, a method according to the presently described embodiments is illustrated. In this regard, the method 600 is initiated upon recognition by the processing module 30 of a signaling pattern (at 602). The signaling pattern is locked (at 604). The processing modeling 30 then transmits a message, as above, to the oncoming vehicle to determine its identity (at 606). A response is received (at 608). The response, in one form, includes information on the identity of the oncoming vehicle. A determination is then made as to whether the identification key provided in the response is valid (at 610). If the key is not valid, the action module 56 of the processing module 30 activates the camera 40 (at 612). The purpose, in this context, for activation of the camera, is to record unauthorized users of the interruption system (at 614).

If, however, the key is determined to be a valid key, the interruption cycle is initiated (at 616). In addition, the camera 40 is activated (at 618) to record violations during the interruption cycle (at 620). It should be appreciated that exemplary violations that may occur in this context are red light violations and the like. Suitable sensor systems could be provided at the site of the traffic light system 10 in order to identify trigger activation of the camera to record such violations.

Figure 7:
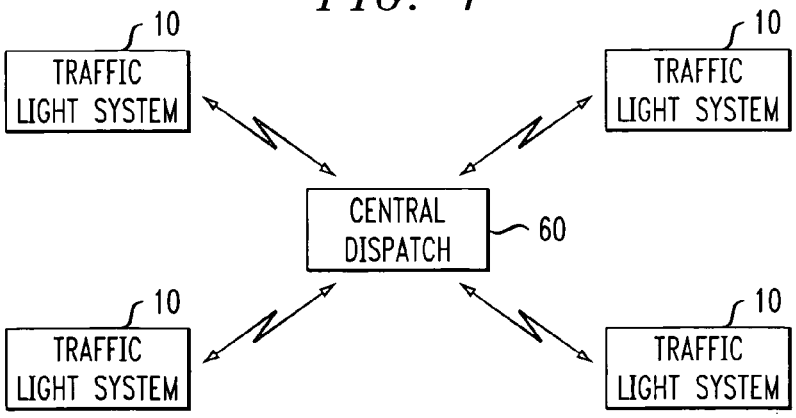

With reference now to FIG. 7, an alternative system according to the presently described embodiments is shown. As shown here, traffic light systems 10 according to the presently described embodiments can be configured to report to a central dispatch unit 60, as shown. This central reporting will allow for coordination of the various traffic light systems 10 as an emergency vehicle passes therethrough. Moreover, the system as shown may also aid in providing navigation information to the drivers of the emergency vehicles and activation of preselected sequences of the traffic light systems.

The above description merely provides a disclosure of particular embodiments of the invention and is not intended for the purposes of limiting the same thereto. As such, the invention is not limited to only the above-described embodiments. Rather, it is recognized that one skilled in the art could conceive alternative embodiments that fall within the scope of the invention.

We claim:

1. A method for providing an interruption cycle for a traffic light system, the method comprising:

recognizing a first signal from a signaling unit of a vehicle;

locking onto the first signal;

transmitting a second signal to the signaling unit of the vehicle;

receiving a third signal in response to the second signal;

determining if the third signal includes information validating the signaling unit of the vehicle as being authorized; and, initiating the interruption cycle if the signaling unit is authorized.

2. The method as set forth in claim 1 wherein the first signal is a strobe pattern.

3. The method as set forth in claim 1 wherein the transmitting comprises transmitting at least one message requesting identification as the second signal.

4. The method as set forth in claim 1 wherein the transmitting comprises transmitting a wake up signal as the second signal.

5. The method as set forth in claim 1 wherein the third signal includes identification information.

6. The method as set forth in claim 1 wherein the determining comprises accessing a database.

7. The method as set forth in claim 1 further comprising waiting for a next detection if the signaling unit is not authorized.

8. The method as set forth in claim 1 further comprising activating a camera to record unauthorized use if the signaling unit is not authorized.

9. The method as set forth in claim 1 further comprising activating the camera to record traffic violations during the interruption cycle.

10. The method as set forth in claim 1 further comprising communicating with a central dispatch unit if the signaling unit is authorized.

11. A system for providing an interruption cycle for a traffic light system, the system comprising:

means for recognizing a first signal from a signaling unit of vehicle;

means for locking onto the first signal;

means for transmitting a second signal to the signaling unit of the vehicle;

means for receiving a third signal in response to the second signal;

means for determining if the third signal includes information validating the signaling unit of the vehicle as being authorized; and, means for initiating the interruption cycle if the signaling unit is authorized.

12. The system as set forth in claim 11 wherein the first signal is a strobe pattern.

13. The system as set forth in claim 11 wherein the second signal comprises at least one message requesting identification.

14. The system as set forth in claim 11 wherein the second signal comprises a wake up signal.

15. The system as set forth in claim 11 wherein the third signal includes identification information.

16. The system as set forth in claim 11 wherein the means for determining comprises means for accessing a database.

17. The system as set forth in claim 11 further comprising a means for waiting for a next strobe detection if the signaling unit is not authorized.

18. The system as set forth in claim 11 further comprising means for activating a camera to record unauthorized use if the signaling unit is not authorized.

19. The system as set forth in claim 11 further comprising means for activating the camera to record traffic violations during the interruption cycle.

20. A system for receiving signals from a signaling unit of a vehicle comprising:

a signal detector operative to detect first signals from the signaling unit; and, a processing module operative to receive the first signals, lock on to the first signals, transmit a second signal to the signaling unit of the vehicle, receive a third signal in response to the second signal, determine if the third signal includes information validating the signaling unit of the vehicle as being authorized, and initiate an interruption cycle if the signaling unit is authorized.

21. The system as set forth in claim 20 wherein the first signal is a strobe pattern.

22. The system as set forth in claim 20 wherein the second signal comprises at least one message requesting identification.

23. The system as set forth in claim 20 wherein the second signal comprises a wake up signal.

24. The system as set forth in claim 20 wherein the third signal includes identification information.

25. The system as set forth in claim 20 wherein the processing module is operative to determine based on accessing a database.

26. The system as set forth in claim 20 wherein the processing module is operative to wait for a next signal detection if the signaling unit is not authorized.

27. The system as set forth in claim 20 wherein the processing module is operative to activate a camera to record unauthorized use if the signaling unit is not authorized.

28. The system as set forth in claim 20 wherein the processing module is operative to activate the camera to record traffic violations during the interruption cycle.

29. The system as set forth in claim 20 wherein the processing module is operative to communicate with a central dispatch unit if the signaling unit is authorized.

* * * * *